US005403006A

United States Patent [19]

Korte-Jungermann

[11] Patent Number: 5,403,006

[45] Date of Patent: Apr. 4, 1995

[54] TEE-OFF ARRANGMENT FOR GOLF

[76] Inventor: Hans-Werner Korte-Jungermann, Kleinkollenburgstr. 58, D-47877 Wilich, Germany

[21] Appl. No.: 119,502

[22] Filed: Sep. 10, 1993

[30] Foreign Application Priority Data

Sep. 13, 1992 [DE] Germany ..... 92 12 177 U

[51] Int. Cl.[6] ..... A63B 57/00

[52] U.S. Cl. ..... 273/162 C; 273/212; 273/33

[58] Field of Search ..... 273/162 C, 162 E, 162 F, 273/32 B, 32 D, 32 F, 33, 212, 204, 205, 207

[56] References Cited

U.S. PATENT DOCUMENTS

| | | | |
|---|---|---|---|
| 1,692,191 | 11/1928 | Towsley | 273/33 |
| 1,852,956 | 4/1932 | Czichos | 273/162 C |
| 1,959,347 | 5/1934 | Czichos | 273/212 |
| 3,844,565 | 10/1974 | Gigliotti | 273/162 E |
| 4,951,945 | 8/1990 | Gamble | 273/33 |
| 4,998,732 | 3/1991 | Gallant | 273/207 |
| 5,011,150 | 4/1991 | Averill | 273/162 C |
| 5,149,088 | 9/1992 | O'Hara | 273/33 |

FOREIGN PATENT DOCUMENTS

| | | | |
|---|---|---|---|
| 2128485 | 5/1984 | United Kingdom | 273/32 B |

*Primary Examiner*—Vincent Millin
*Assistant Examiner*—Steven B. Wong
*Attorney, Agent, or Firm*—Mason, Kolehmainen, Rathburn & Wyss

[57] ABSTRACT

A tee-off arrangement for playing golf includes a golf club and a tee for supporting a golf ball during a teeing-off stroke. The golf club and the tee each have a permanent magnet which cooperate so that the club can be used to pick up the tee from the ground and subsequently inserted in the ground for the next tee shot.

9 Claims, 1 Drawing Sheet

TEE-OFF ARRANGMENT FOR GOLF

BACKGROUND OF THE INVENTION

When playing a game of golf and in particular when teeing off, a tee, which can also be referred to as a tee peg, is pushed into the ground by means of a pointed tip to support the golf ball at a position above the ground level. When then the ball is struck from its position of being supported on the top of the tee, the tee is often hit out of the ground due to the effect of the striking force applied by the club head, and the tee is frequently also damaged. That means that in many cases tees can only be used for a single stroke and are then left lying around on the golf course, either because they are damaged or because the tee is hit away from its position of being inserted into the ground and can then no longer be found.

It will be noted that the tee is inserted into the ground by the player, by manual pressure, which means that to insert the tee the player must stoop over, which may be an uncomfortable position.

SUMMARY OF THE INVENTION

An object of the present invention is to provide a tee-off arrangement for golf, which can at least substantially reduce the disadvantages outlined above.

Another object of the present invention is to provide a tee-off arrangement for golf, which makes the tee considerably easier to handle while further providing that a single tee can also be used for a plurality of teeing-off strokes.

Still another object of the present invention is to provide a tee-off arrangement for a game of golf, which makes it easier for a tee to be fitted into the ground to support a ball thereon.

In accordance with the principles of the present invention the foregoing and other objects are achieved by a tee-off arrangement for a game of golf, comprising a golf club and a tee which can be inserted into the ground by means of a pointed tip for supporting a golf ball during teeing-off. The golf club is adapted to be releasably connectable to the tee by way of a permanent magnet means.

In a preferred feature the golf club has a club shaft and disposed in the upper end region of the club shaft is a first magnet which extends in the longitudinal direction of the club shaft, while the tee, at its side remote from its tip or point, has a second magnet, the pole direction of the magnets being such that a magnetic attraction force is exerted between the free flat side or face of the first magnet of the club and the free end of the second magnet of the tee.

Preferably in that arrangement the first magnet of the club is in the form of a bar magnet while the second magnet of the tee is in the form of a flat magnet.

Because both components, namely the golf club in its upper end region of its shaft and the tee itself, have permanent magnets, the arrangement according to the invention can provide a sufficiently great magnetic force.

Another preferred feature of the invention provides that the upper end region of the shaft of the golf club has a guide and receiving means of sleeve-like or tubular configuration which surrounds a free end portion of the first magnet and the internal profile of which is adapted to receive the external profile of the tee in the region thereof which is disposed around the second magnet.

That configuration gives the advantage that, when the upper end of the golf club shaft, which carries the first magnet, is moved towards a tee which for example is lying on the ground, the first and second magnets attract each other in such a way that the free sides or faces of the magnets face towards each other and the region of the tee which is disposed around the second magnet is received by the guide and receiving means provided by the shaft of the golf club. In that situation the insertion point or tip of the tee then faces in the longitudinal direction of the golf club shaft away from the golf club head, so that the player can insert the tee into the ground at the next location at which it is required, without having to bend or stoop over, by pressing the tee into the ground by the use of the club. In that situation the guide and receiving means prevents the tee from veering off laterally while it is being inserted into the ground. The magnetic forces can be so selected that the golf club shaft can be readily removed from the tee after the tee has been inserted into the ground, in opposition to the effect of the magnetic force produced by the permanent magnet means.

In accordance with another preferred feature of the invention the first magnet which is fitted in the club is in the form of a bar magnet and is disposed in a sleeve portion which is fitted into the upper end of the tube member extending in the longitudinal direction of and forming part of the club shaft, the guide and receiving means being formed on the sleeve, while the free end of the bar magnet is arranged to project relative to the bottom of the guide and receiving means by the distance by which the free flat side or face of the second flat magnet of the tee is arranged set back therein by virtue of the rounded configuration of the golf ball to be supported thereon.

The above-mentioned tube which is usually provided in the interior of the shaft of the golf club comprises either for example metal or plastic material. The end of the tube is usually enclosed by a handle of elastic material. In regard to the manner of mounting the bar magnet as indicated above, the construction in accordance with this preferred feature of the invention affords the advantage that a bar magnet which is for example glued in position in a sleeve as described above can be introduced with the sleeve into the end of the tube of the golf club shaft, a suitable opening first being made in the handle which comprises elastic material. The fact that the free end of the bar magnet projects by the specified distance relative to the bottom of the guide and receiving means provides that the two magnets can bear against each other without an air gap therebetween, thus giving a secure holding effect.

A further preferred feature of the invention can provide that the free end of the bar magnet is at least approximately aligned with the end of the shaft of the club, thereby providing that the magnetic force is operative substantially in the region of the free end of the bar magnet and not laterally thereof, thereby preventing the tee, as a result of the effect of the magnetic force, laterally bearing against the shaft of the club, without properly fitting completely into the guide and receiving means.

In accordance with another preferred configuration of the invention the region of the tee which has the point or tip thereof can be of a sword-like configuration. In addition, the tee may have blades or vanes constituting laterally projecting portions which are preferably so arranged that they extend transversely to the flat side of the sword-like region.

In another preferred feature of the invention the blades or vanes, or laterally projecting portions, have in the region of their junction to the body of the tee a notch or recess such that when the tee is pushed into the ground the blades or vanes exhibit an elastically yielding reaction.

The tee is preferably made from plastic material, for example polyamide, more particularly preferably of a fluorescent color so that the tee can be easily found by visual inspection, for example when it has landed on the ground after the ball has been struck from the top of the tee. In regard to the material used the tee can be made so durable that it can be used a plurality of times.

Further objects, features and advantages of the present invention will be apparent from the following description of a preferred embodiment thereof.

DESCRIPTION OF THE PREFERRED EMBODIMENT

Figure 1:
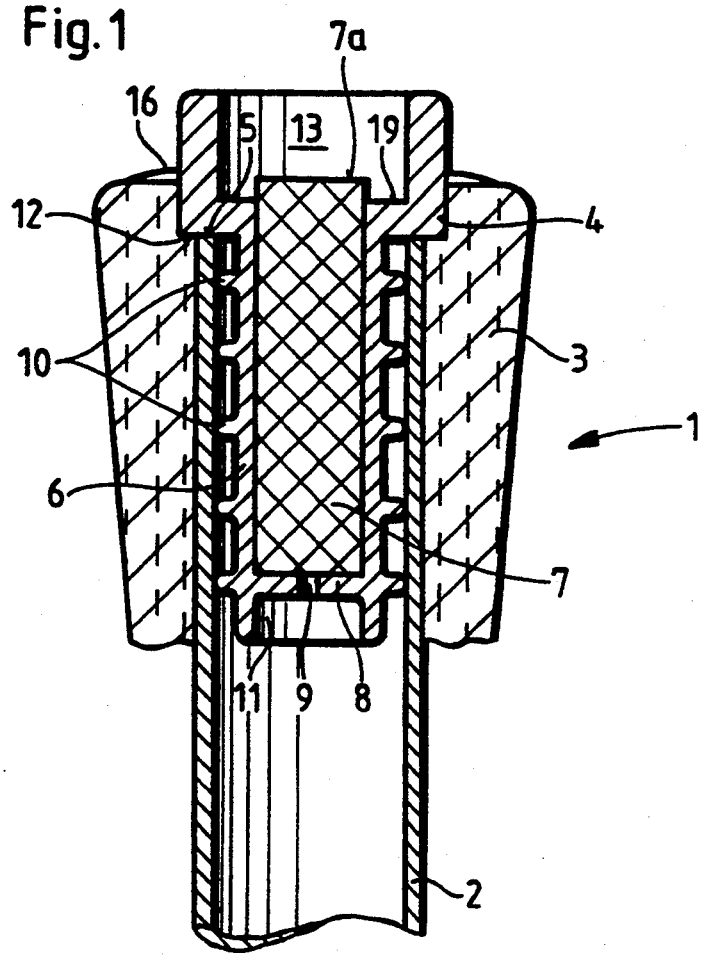
FIG. 1 is a diagrammatic view in section of part of a tee-off arrangement according to the invention, showing the upper end of the shaft of a golf club with bar magnet fitted therein.

Referring firstly to FIG. 1, shown therein is the upper end of a shaft 1 of a golf club, forming part of a tee-off arrangement for a game of golf, in accordance with the invention. FIG. 1 does not show the head region of the golf club which comprises a head mounted at the opposite and therefore lower end of the golf club, at an angle to the club shaft 1.

The club shaft 1 comprises a tube which is generally identified by reference numeral 2 and which for example comprises metal. In the upper end region the tube 2 is surrounded by a handle portion 3 comprising a suitable elastic material, for example rubber, polyurethane or the like. As indicated, the handle portion embraces the upper end region of the club shaft 1 and normally therefore also the upper end region of the tube 2. As shown in FIG. 1, provided in the upper end region of the handle portion 3 is an opening 4 so that the upper end 5 of the tube 2 is exposed after the opening 4 has been formed.

Fitted into the upper end of the tube 2 is a sleeve 6 which in turn receives a magnet in the form of a bar magnet 7 which is secured in the sleeve 6 by suitable means such as glueing. For the purposes of inserting the bar magnet 7 the lower end portion 8 of the sleeve 6 has a vent opening 9 for the release of air from the sleeve 6 as the bar magnet 7 is introduced. Provided on the outside peripheral surface of the sleeve 6 are ribs 10 while provided at the lower end of the sleeve 6 is an annular portion 11. The sleeve 6 is supported with the ribs 10 against the inside surface of the tube 2 and bears with a flange portion 12 disposed at the upper end of the sleeve 6 and extending transversely to the longitudinal direction thereof against the lower end of the opening 4 and thus against the end face 5 of the tube 2. The sleeve 6 is of such a configuration that it enlarges towards its free end, that is to say in its portion which is upward in FIG. 1, and comprises a guide and receiving means 13. The guide and receiving means 13 has an internal profile of round configuration which corresponds to a round external profile as indicated at 14 on a portion of a tee as indicated generally by reference numeral 15 in FIG. 2.

Provided on the outside of the guide and receiving means 13 in FIG. 1 is a peripherally extending collar portion 16 which bears against the upper end face of the handle portion 3.

Figure 2:
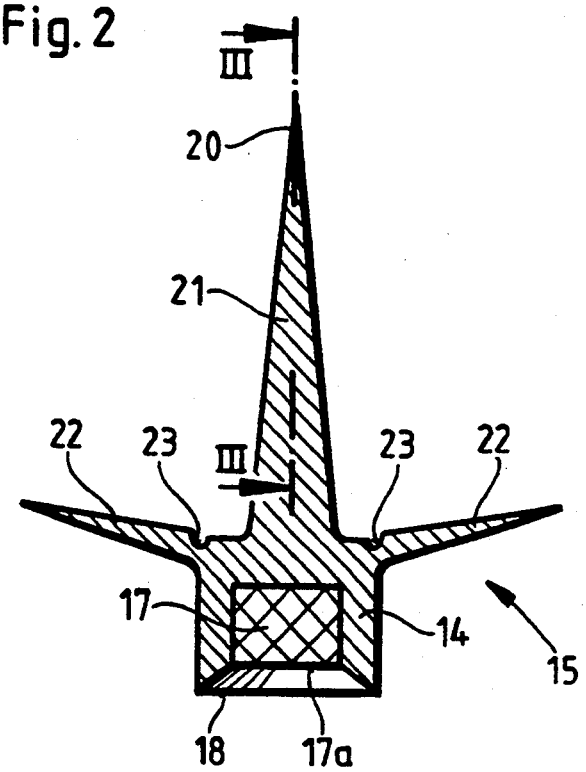
FIG. 2 is a diagrammatic view in section through a tee with a flat magnet fitted therein.
Figure 3:
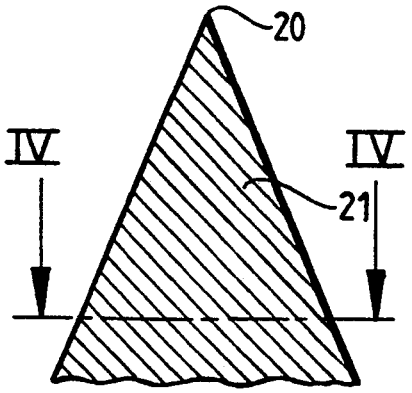
FIG. 3 is a diagrammatic view in section taken along line III—III in FIG. 2.

Looking now at FIG. 2, the tee or tee peg 15 further comprises a permanent magnet in the form of a flat magnet 17 having a free flat side or face 17*a*. The flat side or face 17*a* is arranged to be set back relative to the end 18 of the tee 15, which faces downwardly in FIG. 2, in such a way that the space thus defined by the set-back configuration is suitable for receiving the rounded configuration of the golf ball which is to be struck off the top of the tee 15 when it is inserted into the ground with the golf ball resting thereon. It will be seen therefore that the tee 15 is inserted into the ground by means of a point or tip as indicated at 20, the magnet 17 thus being arranged on the tee 15 at its side which is remote from the point 20.

The pole direction of the magnets 7 (FIG. 1) and 17 (FIG. 2) is so selected that a magnetic attraction force is exerted between the face 7*a* of the magnet 7 of the club and the face 17*a* of the magnet 17 of the tee 15.

Looking again at FIG. 1, the free end of the magnet 7 of the club, as indicated at 7*a*, is arranged to project beyond the bottom 19 of the guide and receiving means 13 by a distance corresponding to the distance by which the face 17*a* of the flat magnet 17 is set back in the tee 15, so that, when the tee is received with its region 14 by the space in the guide and receiving means 13, the face 7*a* of the magnet 7 and the face 17*a* of the magnet 17 bear against each other without an air gap therebetween.

Figure 4:
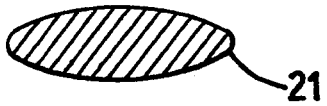
FIG. 4 is a cross-sectional view taken along line IV—IV of FIG. 3.

As indicated above, the tee 15 has a point 20 by which the tee can be fitted into the ground to support a golf ball on the tee. The tee further has a body 21, adjoining the point 20, having a flattened elliptical or oval transverse cross-section, as can be seen from FIG. 4.

In addition, the tee 15 has blades or vanes 22 forming laterally projecting portions which extend transversely relative to the longitudinal direction of the body 21, at respective sides of the flat side surfaces thereof. In addition, in the region where the blades or vanes 22 are joined to the body of the tee 15, there is a notch or recess as indicated at 23, such that when the tee 15 is pushed into the ground, the blades or vanes 22 exhibit an elastically yielding reaction upon coming into contact with the surface of the ground.

It will be seen therefore that, when the tee with the blade-like point portion 20, and body 21 is inserted into the ground in such a way that the flat sides of the body point in the direction in which the ball supported on the tee 15 is to be struck, the body of the tee 15 will cut through the ground like a knife when the tee 15 is hit out of the ground by virtue of the player striking the ball resting on the tee. As a result, the tee presents a lower degree of resistance to its movement through the ground and can thus be more readily disengaged from the ground and flung through the air. That can at least substantially reduce the risk of damage to the tee, which would otherwise be caused by the tee tending to hold fast in the ground even when struck by the club in the course of the player striking the ball.

However the blades or vanes 22 serve to increase the wind resistance of the tee so that, when the tee has been hit out of the ground and is flying through the air, the blades or vanes cause the tee to come back to the ground again after a short distance so that the player can pick up the tee again at a relatively small distance from his point of striking the ball, using the shaft of his club. It will be noted however that the blades or vanes 22 also have the effect of causing the tee to assume a stable position when it is pressed into the ground. The notches or recesses 23 which produce the elastically yielding reaction serve to prevent a tee, upon being pressed into the ground, springing back upwardly again as a result of the blades or vanes bearing against the surface of the ground and thus so-to-speak re-extracting the tee upwardly from the ground.

It will be seen therefore that the tee-off arrangement according to the invention which provides that the golf club is adapted to be releasably connectable to the tee 15 by way of the permanent magnets 7 and 17 gives the advantage that, after the player has struck the ball from the top of the tee on which the ball was resting and the tee has as a result been flung a distance away from the point of striking, the player can use the handle end of the golf club to pick up the tee again by the co-operation of the respective magnets 7 and 17.

It will be appreciated that the above-described arrangement according to the invention ha s been set forth solely by way of example and illustration of the principles of the present invention and that various modifications and alterations may be made therein without thereby departing from the spirit and scope of the invention.

What is claimed is:

1. A tee-off arrangement for golf comprising:

a golf club having a shaft with a tube at an upper end portion;

a tee having a body with a pointed end adapted to be inserted into the ground and an opposite end for supporting a golf ball during tee-off; and permanent magnet means detachably interconnecting said club and said tee for picking up and inserting said tee in the ground, said permanent magnet means including a first magnet on said club and a second magnet on said tee, said magnets having pole directions aligned for exerting attractive magnetic force between said club and said tee;

said club having a hollow, open end, sleeve secured in an upper end portion of said tube and having a recess for containing said first magnet with a pole face thereof spaced a distance inwardly toward a bottom wall of said sleeve away from said open end, said second magnet having a pole face spaced a distance inwardly of said opposite end of said tee for supporting said golf ball on said opposite site ends out of contact with said pole face of said tee, said spaced distance between said open end of said sleeve and said pole face of said first magnet selected to allow said pole faces of said first and second magnets to contact one another when said opposite end of said tee is inserted into said open end of said sleeve.

2. An arrangement as set forth in claim 1 wherein said first magnet is in the form of a bar magnet and said second magnet is in the form of a flat magnet.

3. An arrangement as set forth in claim 1 wherein said sleeve has an internal profile adapted to receive and matching an external profile of said upper end portion of said tee around said second magnet.

4. An arrangement as set forth in claim 3 wherein said tube extends in a longitudinal direction along said club shaft and wherein said first magnet is in the form of a bar magnet having an upper end portion mounted to project outwardly relative to a bottom wall of said sleeve by the same amount that a pole face of said second magnet is set back from an upper end of said tee in order to accommodate the rounded configuration of a golf ball to be supported thereon.

5. An arrangement as set forth in claim 1 wherein said pole face of said first magnet is approximately aligned with an upper end of said club shaft.

6. An arrangement as set forth in claim 1 wherein said body of said tee has a flattened elliptical cross-section between said pointed end and said opposite end.

7. An arrangement as set forth in claim 6 wherein said tee has a plurality of laterally projecting vanes extending outwardly of said body.

8. An arrangement as set forth in claim 7 wherein said laterally projecting vanes extend transversely outwardly of opposite flattened sides of said elliptical cross-section of said body.

9. An arrangement as set forth in claim 7 wherein said laterally projecting vanes have notches formed adjacent a junction with said body of said tee so that when said tee is pushed into the ground said laterally projecting vanes exhibit an elastically yielding reaction.

* * * * *